US011086264B2

(12) United States Patent
Furuya et al.

(10) Patent No.: US 11,086,264 B2
(45) Date of Patent: Aug. 10, 2021

(54) TONER REMOVAL FROM TRANSFER ROLLER

(71) Applicant: HEWLETT-PACKARD DEVELOPMENT COMPANY, L.P., Spring, TX (US)

(72) Inventors: Satoru Furuya, Yokohama (JP); Shun Ikeura, Yokohama (JP); Satoru Hori, Yokohama (JP)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/051,055

(22) PCT Filed: May 22, 2019

(86) PCT No.: PCT/US2019/033543
§ 371 (c)(1),
(2) Date: Oct. 27, 2020

(87) PCT Pub. No.: WO2020/018176
PCT Pub. Date: Jan. 23, 2020

(65) Prior Publication Data

US 2021/0141331 A1 May 13, 2021

(30) Foreign Application Priority Data

Jul. 18, 2018 (JP) ..... JP2018-134672

(51) Int. Cl.
*G03G 15/16* (2006.01)
*G03G 21/00* (2006.01)

(52) U.S. Cl.
CPC ..... *G03G 21/0035* (2013.01); *G03G 15/161* (2013.01); *G03G 2215/1652* (2013.01); *G03G 2215/1661* (2013.01); *G03G 2221/0005* (2013.01)

(58) Field of Classification Search
CPC ..... G03G 15/161; G03G 15/168; G03G 21/0035; G03G 2215/1652; G03G 2215/1661; G03G 2221/0005; G03G 2221/001; G03G 2221/0015
USPC ..... 399/101
See application file for complete search history.

(56) References Cited

U.S. PATENT DOCUMENTS 5,268,723 A 12/1993 Kikuchi
6,175,711 B1 1/2001 Yoshino et al.
7,440,711 B2 10/2008 Kishi
7,668,478 B2 * 2/2010 Al ..... G03G 15/168 399/101

(Continued)

FOREIGN PATENT DOCUMENTS

JP 20010265132 9/2001
JP 20010312154 11/2001

*Primary Examiner* — William J Royer
(74) *Attorney, Agent, or Firm* — Staas & Halsey, LLP

(57) ABSTRACT

A device for removing toner attached to a transfer roller in an image forming apparatus is disclosed. The device includes a bar brush to contact an outer circumferential surface of the transfer roller, where the bar brush extends along a part of a longitudinal length of the transfer roller. The device includes an elongated cleaning member to contact the outer circumferential surface of the transfer roller, where the elongated cleaning member extends along the longitudinal length, entirely, of the transfer roller.

15 Claims, 4 Drawing Sheets

(56) References Cited

U.S. PATENT DOCUMENTS

| | | | | |
|---|---|---|---|---|
| 7,773,907 | B2 | 8/2010 | Takayanagi | |
| 8,135,303 | B2 | 3/2012 | Ai et al. | |
| 8,879,937 | B2 | 11/2014 | Zaima | |
| 9,465,330 | B2 | 10/2016 | Morimoto | |
| 10,101,689 | B2 * | 10/2018 | Iwasawa et al. ..... | G03G 15/161 |
| 2019/0310581 | A1 * | 10/2019 | Miyake et al. ..... | G03G 15/161 |

* cited by examiner

TONER REMOVAL FROM TRANSFER ROLLER

CROSS REFERENCE TO RELATED APPLICATIONS

This application is filed under 35 U.S.C. 0.371 as a National Stage of PCT International Application No. PCT/US2019/033543, filed on May 22, 2019, in the U.S. Patent and Trademark Office, which claims the priority benefit of Japanese Patent Application No. 2018-134672, filed on Jul. 18, 2018, in the Japan Patent Office. The disclosures of PCT International Application No. PCT/US2019/033543 and Japanese Patent Application No. 2018-134672 are incorporated by reference herein in their entireties.

BACKGROUND

An image forming apparatus may include a transfer roller which is rotated to follow the movement of an intermediate transfer belt while pressing a sheet of recording medium onto the intermediate transfer belt, so as to transfer a toner image from the intermediate transfer belt to the sheet of recording medium. Some image forming apparatus may have a brush for each of several predetermined regions on the transfer roller in a longitudinal direction of the transfer roller, for intensively cleaning the predetermined regions on the transfer roller.

DETAILED DESCRIPTION

Figure 1:
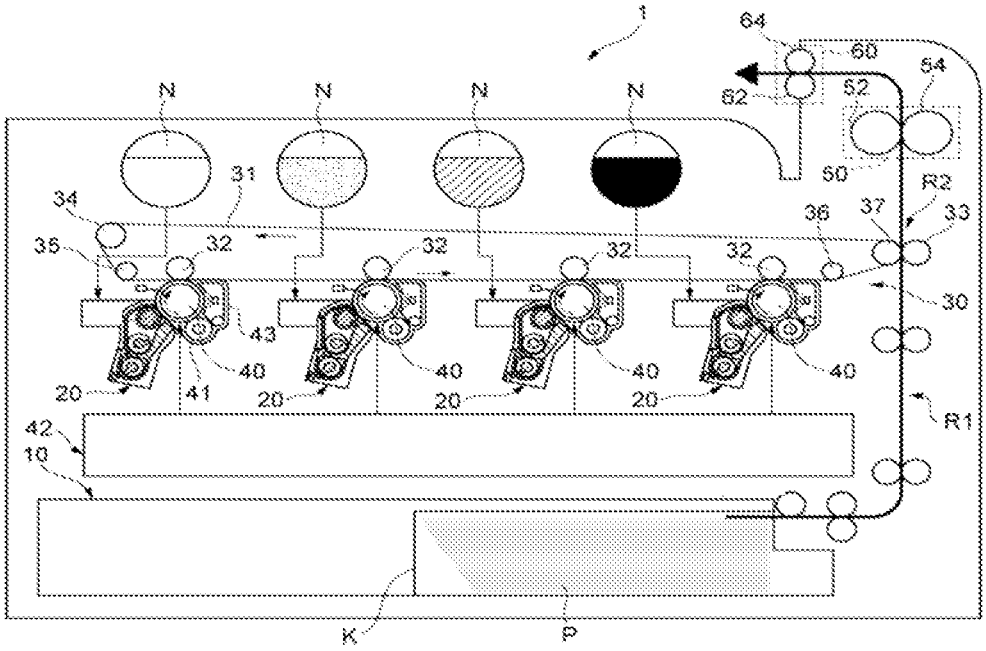
FIG. 1 shows an example image forming apparatus which can implement a device for removing toner attached to a transfer roller according to various examples of the present disclosure.

In the following description, with reference to the drawings, the same reference numbers are assigned to the same components or to similar components having the same function, and overlapping description is omitted.

The example image forming apparatus may include a transfer roller which is rotated to follow the movement of an intermediate transfer belt while pressing a sheet of recording medium onto the intermediate transfer belt, so as to transfer a toner image from the intermediate transfer belt to the sheet of recording medium. When the image forming apparatus does not have a mechanism for withdrawing the transfer roller from the intermediate transfer belt and the intermediate transfer belt is driven without a supply of paper, toner may unnecessarily be transferred onto the transfer roller as it is directly pressed against the intermediate transfer belt that carries a toner image. The toner attached to the transfer roller may stain the back of paper during printing.

There are cases where it is useful to intensively clean several predetermined regions on the transfer roller in the longitudinal direction of the transfer roller. For example, during image adjustment, the image forming apparatus may form a toner image (image adjustment pattern) only in several areas on the intermediate transfer belt corresponding to sensors. As a result, toner may intensively attach to several predetermined areas on the transfer roller in the longitudinal direction of the transfer roller. In such a case, a brush may be disposed for each of the predetermined areas on the transfer roller. During cleaning, a bias voltage having an opposite polarity to the transfer bias may be applied to the transfer roller for increasing the cleaning property of the brush. After prolonged use, the surface electric resistance of the portion of the transfer roller contacting the brush may increase relative to the surface electric resistance of the portion not contacting the brush, and variations in transfer density may arise in the longitudinal direction of the transfer roller during printing.

An example device for removing toner attached to a transfer roller in an image forming apparatus, includes a first bar brush disposed to contact with an outer circumferential surface of the transfer roller and extending along part of a longitudinal length of the transfer roller (along a longitudinal orientation of the transfer roller), and an elongated cleaning member disposed to contact with the outer circumferential surface of the transfer roller and extending along the entire longitudinal length of the transfer roller for uniformly distributing surface electric resistance over the outer circumferential surface of the transfer roller. The device may include a plurality of the first bar brushes spaced from each other and arranged in a row along the longitudinal direction of the transfer roller. The longitudinal length may be associated with a longitudinal orientation of the transfer roller.

The elongated cleaning member may be disposed on a downstream side of the first bar brush in a rotational direction of the transfer roller, with spacing (e.g. spaced apart) from the first bar brush.

The device may further include a bias application unit to apply a bias voltage (or "removal bias") to the transfer roller, the bias voltage having the same polarity as a charge polarity of the toner attached to the transfer roller. The bias application unit may apply the removal bias to the transfer roller during image adjustment. The bias application unit may apply, during printing, a bias voltage ("transfer bias") having a polarity opposite to the charge polarity of the toner to the transfer roller.

The elongated cleaning member may be a second bar brush. The elongated cleaning member may be an elongated roller or a flexible sheet. The second bar brush may have a fiber stress smaller (e.g. lower) than a fiber stress of the first bar brush and a fiber density larger than a fiber density of the first bar brush. The second bar brush may have a fiber diameter smaller than a fiber diameter of the first bar brush and a fiber density larger than the fiber density of the first bar brush.

The device may further include a third bar brush disposed to contact with the outer circumferential surface of the transfer roller on a downstream side of the second bar brush in the rotational direction of the transfer roller and extending along the part of the longitudinal length of the transfer roller. The device may include a plurality of the third bar brushes spaced apart from each other and arranged in a row along the longitudinal direction of the transfer roller. The third bar brush may be disposed adjacent to the second bar brush on the downstream side of the second bar brush in the rotational direction of the transfer roller. The second bar brush may have a fiber stress smaller (e.g. lower) than a fiber stress of the third bar brush and a fiber density larger than a fiber density of the third bar brush. The second bar brush may have a fiber diameter smaller than a fiber diameter of the third bar brush and a fiber density larger than the fiber density of the third bar brush.

The device may further include a base member having a curved surface parallel to the outer circumferential surface of the transfer roller, and each of the first, second and third bar brushes may include brush bristles extending substantially perpendicularly from the curved surface of the base member to the outer circumferential surface of the transfer roller. The front end surface (or contact end) of each of the first, second and third bar brushes may have a profile curved along the outer circumferential surface of the transfer roller.

An example method of removing toner attached to a transfer roller in an example image forming apparatus, includes disposing a first bar brush extending along part of a longitudinal length of the transfer roller to contact with an outer circumferential surface of the transfer roller, disposing an elongated cleaning member extending along the entire longitudinal length of the transfer roller to contact with the outer circumferential surface of the transfer roller, and rotating the transfer roller.

In some examples of the method, the rotating of the transfer roller may include rotating the transfer roller while applying to the transfer roller a bias voltage having the same polarity as a charge polarity of the toner attached to the transfer roller.

In some examples of the method, the disposing of the elongated cleaning member to contact with the outer circumferential surface of the transfer roller may include disposing the elongated cleaning member on a downstream side of the first bar brush in a rotational direction of the transfer roller, with spacing (e.g. spaced apart) from the first bar brush.

In some examples of the method, the elongated cleaning member may be a second bar brush. The second bar brush may have a fiber stress smaller (e.g. lower) than a fiber stress of the first bar brush and a fiber density larger than a fiber density of the first bar brush. The second bar brush may have a fiber diameter smaller than a fiber diameter of the first bar brush and a fiber density larger than the fiber density of the first bar brush.

Some examples of the method may further comprise, prior to rotating the transfer roller, disposing a third bar brush extending along the part of the longitudinal length of the transfer roller to contact with the outer circumferential surface of the transfer roller on a downstream side of the second bar brush in the rotational direction of the transfer roller. The second bar brush may have a fiber stress smaller (e.g. lower) than a fiber stress of the third bar brush and a fiber density larger than a fiber density of the third bar brush. The second bar brush may have a fiber diameter smaller than a fiber diameter of the third bar brush and a fiber density larger than the fiber density of the third bar brush.

In some examples of the method, the disposing of the third bar brush to contact with the outer circumferential surface of the transfer roller on the downstream side of the second bar brush in the rotational direction of the transfer roller may include disposing the third bar brush adjacent to the second bar brush on the downstream side of the second bar brush in the rotational direction of the transfer roller.

In some examples of the method, the front end surface (or contact end) of each of the first, second and third bar brushes may have a profile curved along the outer circumferential surface of the transfer roller.

Various examples of the present disclosure will now be explained in detail with reference to the drawings.

FIG. 1 shows an example image forming apparatus 1 which can implement a device for removing toner attached to a transfer roller in accordance with various examples. The image forming apparatus 1 includes, for each of four toner colors (magenta, yellow, cyan and black), a toner bottle N, a developing device 20, a photosensitive drum 40, a charge roller 41, and a cleaning unit 43. The image forming apparatus 1 also includes a recording medium conveyance unit 10, a transfer device 30, an exposure unit 42, a fixing device 50, and a discharge device 60. The transfer device 30 includes an intermediate transfer belt 31, support rollers 34, 35, 36 and 37 for supporting the intermediate transfer belt 31 to allow a circulating movement, four primary transfer belt rollers 32 respectively corresponding to the four photosensitive drums 40, and a secondary transfer roller (transfer roller) 33 that is rotated to follow the movement of the intermediate transfer belt 31 while pressing a sheet of paper P onto the intermediate transfer belt 31. The support roller 37 is adapted as a drive roller for circularly moving the intermediate transfer belt 31 in a direction indicated by the arrows. The example device may be used for removing toner attached to the secondary transfer roller 33. The example devices disclosed herein may be used in other image forming apparatuses.

In the example image forming apparatus 1, each of the photosensitive drums 40 is charged by the corresponding charge roller 41, to form thereon an electrostatic latent image by the exposure unit 42 according to image data for the corresponding color, and thereafter the corresponding developing device 20 develops the electrostatic latent image with a toner from the corresponding toner bottle N to form a toner image. The four color images respectively formed on the four photosensitive drums 40 are then successively overlaid on the intermediate transfer belt 31 by the primary transfer belt rollers 32 to synthesize a single toner image. The toner image synthesized on the intermediate transfer belt 31 is then transferred onto the sheet of paper P by the secondary transfer roller 33, and fixed onto the sheet of paper P by the fixing device 50 including a heater roller 54 and a pressure roller 52. The sheet of paper P is conveyed one by one by the recording medium conveyance unit 10 from a cassette K along a conveyance path R1, R2 and discharged from the discharge device 60 including discharge rollers 62, 64 after receiving transfer of the toner image by the secondary transfer roller 33.

Figure 2:
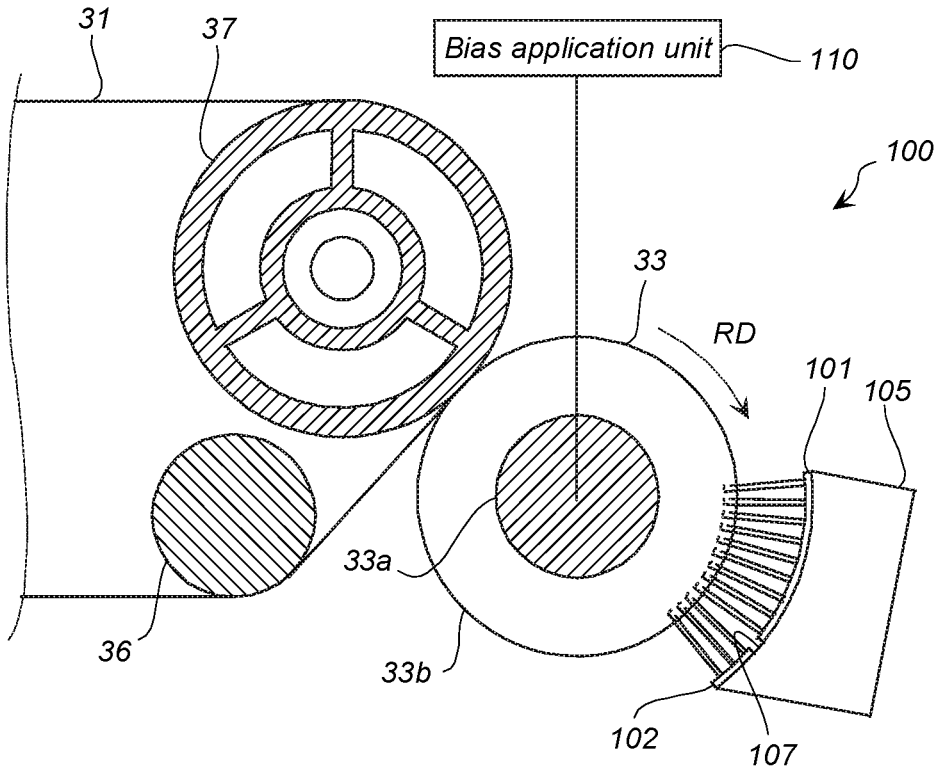
FIG. 2 shows an example device for removing toner attached to a transfer roller.
Figure 3:
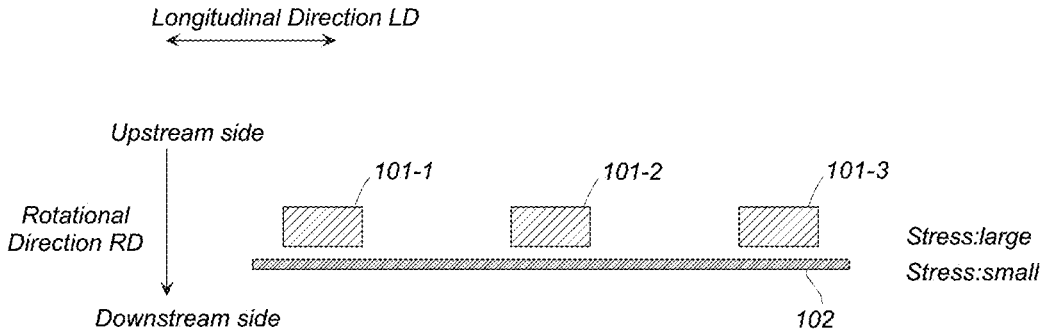
FIG. 3 shows an example arrangement of bar brushes in the example.

FIG. 2 shows an example device 100 for removing toner attached to the transfer roller 33, together with part of the image forming apparatus 1. FIG. 3 shows an arrangement of bar brushes on a base member 105 (not shown) in the device 100, viewed from the side of the transfer roller 33 in FIG. 2. As shown in FIG. 2 and FIG. 3, the device 100 includes a first bar brush 101 (101-1, 101-2, 101-3) disposed to contact with an outer circumferential surface of the transfer roller 33 and extending along part of the length of the transfer roller 33 in the longitudinal direction LO, and an elongated cleaning member 102 disposed to contact with the outer circumferential surface of the transfer roller 33 and extending along the entire length of the transfer roller 33 in the longitudinal direction LO for uniformly distributing surface electric resistance over the outer circumferential surface of the transfer roller 33. The elongated cleaning member 102 may include a second bar brush 102. The first bar brushes 101-1, 101-2 and 101-3 are spaced from each other and arranged in a row along the longitudinal direction LO of the transfer roller 33. The elongated cleaning member 102 may include an elongated roller in some examples, or a flexible sheet in other examples.

FIG. 3 shows three first bar brushes 101-1, 101-2 and 101-3. In some examples, the device 100 may include one, two, four or five first bar brushes 101. In some examples, the device 100 may include six or more first bar brushes 101. The length of the first bar brush 101 may be determined, for example, according to the length of a sensor for reading an image adjustment pattern on the intermediate transfer belt 31. However, the length of the first bar brush 101 may be varied depending on examples, according to the intended purpose of the cleaning for example.

A width of the front end surface (or contact end) of the first bar brush 101 in the rotational direction RD of the transfer roller 33 may be 5 mm or more, and in some examples, 10 mm or more, so as to impart the first bar brush 101 with effective cleaning capability. Further, the width of the front end surface (or contact end) of the first bar brush 101 in the rotational direction RD of the transfer roller 33 may be 50 mm or less, and in some examples, 30 mm or less, so that the first bar brush 101 is inhibited from hindering the rotation of the transfer roller 33.

A width of the front end surface (or contact end) of the second bar brush 102 in the rotational direction RD of the transfer roller 33 may be 3 mm or more, and in some examples, 5 mm or more, so as to impart the second bar brush 102 with an effective capability to make uniform the surface electric resistance. Further, the width of the front end surface (or contact end) of the second bar brush 102 in the rotational direction RD of the transfer roller 33 may be 30 mm or less, and in some examples, 20 mm or less, so that the second bar brush 102 is inhibited from hindering the rotation of the transfer roller 33.

With the second bar brush 102, the device 100 can make uniform variations in the surface electric resistance on the outer circumferential surface of the transfer roller 33 caused by the first bar brush 101, and the second bar brush 102 can also scrape off the toner dispersed away by the first bar brush 101 on the outer circumferential surface of the transfer roller 33.

The second bar brush 102 may be located a predetermined distance away from the first bar brush 101 on a downstream side of the first bar brush 101 in the rotational direction RD of the transfer roller 33. With the provision of the spacing on the upstream side of the second bar brush 102, the second bar brush 102 can be imparted with the capability to make uniform the surface electric resistance. The distance of separation between the first bar brush 101 and the second bar brush 102 in the rotational direction RD of the transfer roller 33 may be 3 mm or more, and in some examples, 5 mm or more, so as to impart the second bar brush 102 with the effective capability to make uniform the surface electric resistance.

When the fiber density (number/cm$^2$) of the second bar brush 102 is increased, the contact between the transfer roller 33 and the second bar brush 102 is improved, and the capability of the second bar brush 102 to make uniform the surface electric resistance is enhanced. However, if the fiber density of the second bar brush 102 is simply increased, the contact resistance (frictional resistance) between the second bar brush 102 and the transfer roller 33 is increased and may hinder the rotation of the transfer roller 33. As such, when the fiber density of the second bar brush 102 is made higher than the fiber density (number/cm$^2$) of the first bar brush 101, the fiber diameter (denier) of the second bar brush 102 may also be made smaller than the fiber diameter (denier) of the first bar brush 101, to inhibit hindering the rotation of the transfer roller 33. Accordingly, the second bar brush 102 may have a fiber diameter smaller than the fiber diameter of the first bar brush 101 and a fiber density higher than the fiber density of the first bar brush 101.

When the other conditions such as the fiber length and the fiber material are constant, the second bar brush 102 may have a fiber stress (N) smaller (e.g. lower) than the fiber stress (N) of the first bar brush 101 when the fiber diameter (denier) of the second bar brush 102 is smaller than the fiber diameter (denier) of the first bar brush 101.

In each of the first and second bar brushes 101 and 102, the product of the fiber diameter (denier) and the fiber density (number/cm$^2$) may be 200,000 or more, and in some examples, 400,000 or more, so as to obtain an effective cleaning capability. Further, in each of the first and second bar brushes 101 and 102, the product of the fiber diameter (denier) and the fiber density (number/cm$^2$) may be 1,000,000 or less, and, in some examples, 600,000 or less, in order to inhibit hindering the rotation of the transfer roller 33.

The device 100 may further include a bias application unit 110 to apply to the transfer roller 33 a bias voltage ("removal bias") having the same polarity as a charge polarity of the toner attached to the transfer roller 33. The application of the removal bias to the transfer roller 33 can reduce the attachment of the toner to the transfer roller 33, and can also facilitate removal of the toner attached to the transfer roller 33, to thereby enhance the cleaning capability of the device 100. The application of the removal bias is particularly useful in the sense that it can reinforce the cleaning capability of bar brushes when stationary brushes such as the first bar brush 101 and the second bar brush 102 are used. The absolute value of the removal bias may be 10 V or more, and in some examples, 100 V or more, for preventing the attachment of the toner to the transfer roller 33. The absolute value of the removal bias may be 500 V or less, and in some examples 400 V or less, for preventing the attachment of the toner to the transfer roller 33.

During image adjustment, the transfer roller 33 may be rotated to follow the rotation of the drive roller 37, without holding a sheet of paper P between the drive roller 37 and the transfer roller 33 and in a state of being pressed against an outer peripheral surface of the intermediate transfer belt 31 on which a toner image is formed, and this may cause unnecessary attachment of the toner from the intermediate transfer belt 31 to the transfer roller 33. The bias application unit 110 may thus apply the removal bias to the transfer roller 33 during image adjustment. In this case, the charge polarity of the toner which may attach to the transfer roller 33 is the same as the charge polarity of the toner that constitutes the toner image on the intermediate transfer belt 31. During printing, the transfer roller 33 is rotated to follow the rotation of the drive roller 37 while holding the sheet of paper P between the drive roller 37 and the transfer roller 33, with the sheet of paper P being pressed against the outer peripheral surface of the intermediate transfer belt 31 on which a toner image is formed. The bias application unit 110 may apply to the transfer roller 33 a bias voltage ("transfer bias") having a polarity opposite to the charge polarity of the toner constituting the toner image on the intermediate transfer belt 31, so as to facilitate transfer of the toner image from the intermediate transfer belt 31 to the sheet of paper P. As such, the polarity of the removal bias is opposite to that of the transfer bias.

As shown in FIG. 2, the front end surface (or contact end) of each of the first and second bar brushes 101 and 102 may have a profile curved along the outer circumferential surface of the transfer roller 33. The brush bristles of each bar brush may thus be made to contact with the outer circumferential surface of the transfer roller 33 at a substantially uniform pressure in the rotational direction RD of the transfer roller 33, and the cleaning capability of each of the first and second bar brushes 101 and 102 may be increased as compared with cases where the front end surface (or contact end) of each bar brush has a planar profile.

The device 100 may further include a base member 105 having a curved surface 107 parallel to the outer circumferential surface of the transfer roller 33. Each of the first and second bar brushes 101 and 102 may include brush bristles extending substantially perpendicularly from the curved surface 107 of the base member 105 to the outer circumferential surface of the transfer roller 33 (e.g. the bristles may extend in a substantially radial direction relative to the curved surface). With the first and second bar brushes 101 and 102 each including brush bristles extending substantially perpendicularly to the outer circumferential surface of the transfer roller 33, a high cleaning capability can be obtained for each of the first and second bar brushes 101 and 102.

Each of the first and second bar brushes 101 and 102 includes a flexible sheet, such as a base fabric, and the brush bristles planted on the flexible sheet, and the flexible sheet is fixed onto the curved surface 107 of the base member 105 using a double-sided adhesive tape or an adhesive, such that the tip ends of the brush bristles make contact with the outer circumferential surface of the transfer roller 33. The brush bristles may be electrically insulating or conductive. If the brush bristles are electrically insulating, the brush bristles may be made of, for example, PET, nylon, acrylic, or a combination of these. If the brush bristles are electrically conductive, the bar brushes 101 and 102 may be made to electrically float relative to the transfer roller 33. The length of the brush bristles of each of the first and second bar brushes 101 and 102 may be substantially constant. As far as the difference between the maximum amount of engagement and the minimum amount of engagement of the brush bristles of each of the first and second bar brushes 101 and 102 with the transfer roller 33 is within 1.0 mm, the bar brushes can be made to contact with the transfer roller 33 at a substantially uniform pressure, while tolerating manufacturing errors and assembly variations in each of the first and second bar brushes 101 and 102. The amount of engagement of the brush bristles with the transfer roller may be expressed by, provided that the transfer roller does not exist, the length (mm) over which the brush bristles extend from the outer circumferential surface of the transfer roller, if existent, into the transfer roller.

The transfer roller includes a cylindrical metal core 33*a* and a cylindrical foam layer 33*b* provided on the outer circumference of the metal core 33*a*. The ends of the metal core 33*a* of the transfer roller 33 may be protruded by a certain length beyond the edges of the foam layer 33*b* so that the transfer roller 33 can be rotatably mounted in the image forming apparatus 1. The outer circumferential surface of the cylindrical portion of the transfer roller 33, excluding the protrusions, may be the subject of cleaning. The cylindrical portion of the transfer roller excluding the protrusions may be referred to herein as "transfer roller", for conciseness. For example, in the present specification "longitudinal length of the transfer roller" means the longitudinal length of the cylindrical portion of the transfer roller excluding the protrusions, and "outer circumferential surface of the transfer roller" means the outer circumferential surface of the cylindrical portion of the transfer roller excluding the protrusions (i.e., equal to the outer circumferential surface of the foam layer).

The foam layer 33*b* of the transfer roller 33 includes cells and cell walls. The foam layer 33*b* may have a porosity of 66% or more, for reducing the staining of the back of the sheet of paper P. Further, to ensure the transfer property of the transfer roller 33, the cells in the foam layer 33*b* may have a diameter of 500 μm or less in the cross section of the foam layer 33*b*. Also, to ensure the releasability from the outer circumferential surface of the transfer roller 33, the transfer roller 33 may have a frictional coefficient of 1.06 or less relative to the intermediate transfer belt 31, under the environment of 33° C. in temperature and 85% in humidity.

Figure 4:
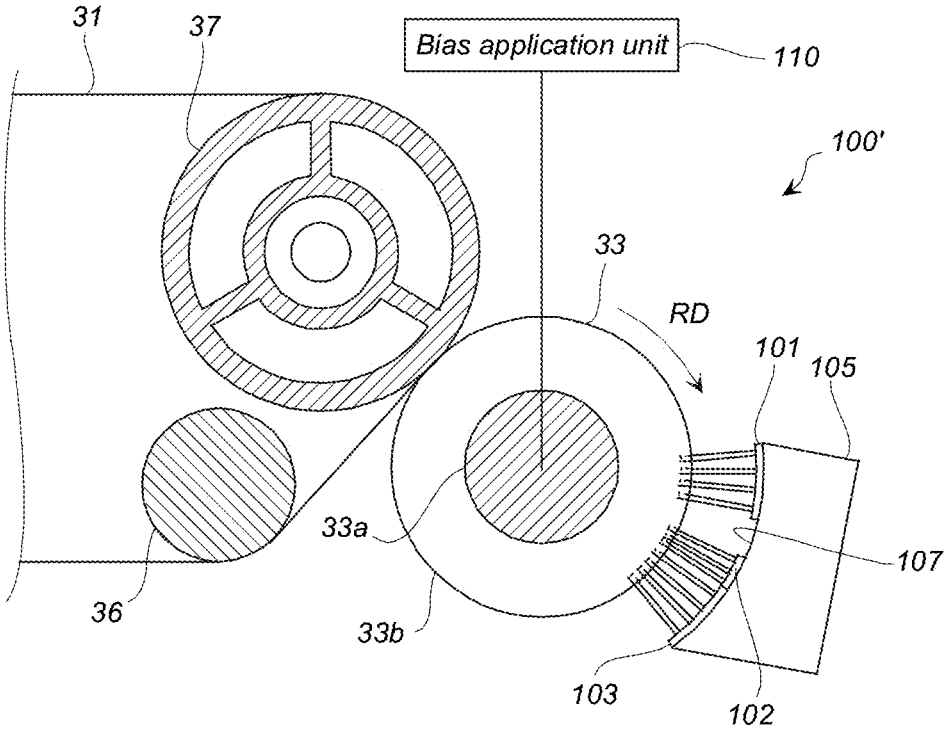
FIG. 4 shows an example device for removing toner attached to a transfer roller.
Figure 5:
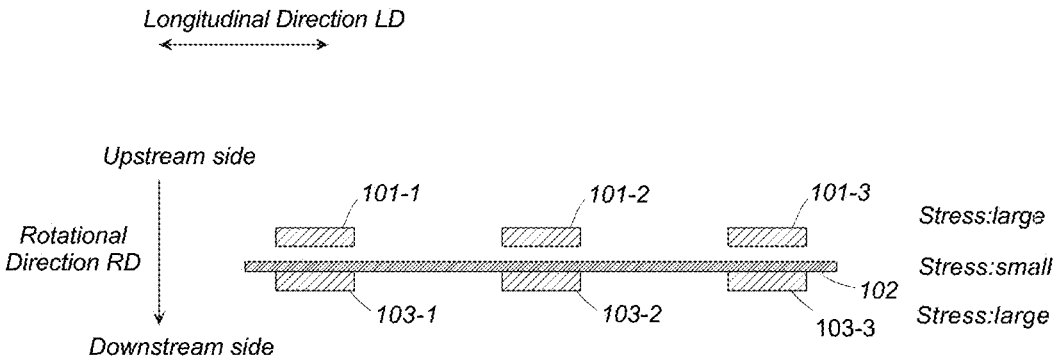
FIG. 5 shows an example arrangement of bar brushes in the example device.

FIG. 4 shows, together with part of the image forming apparatus 1, an example device 100' for removing toner attached to the transfer roller, and FIG. 5 shows an arrangement of bar brushes on the base member 105 (not shown) in the device 100' viewed from the side of the transfer roller 33 in FIG. 4. The constituent elements of the device 100' having corresponding constituent elements in the device 100 are marked with the same reference signs of the corresponding constituent elements of the device 100 to avoid duplicate description. As shown in FIG. 4 and FIG. 5, the device 100' includes a first bar brush 101 (101-1, 101-2, 101-3) disposed to contact the outer circumferential surface of the transfer roller 33 and extending along part of the length of the transfer roller 33 in the longitudinal direction LD, an elongated cleaning member 102 disposed to contact with the outer circumferential surface of the transfer roller 33 and extending along the entire length of the transfer roller 33 in the longitudinal direction LD for uniformly distributing surface electric resistance over the outer circumferential surface of the transfer roller 33, and a third bar brush 103 (103-1, 103-2, 103-3) disposed to contact with the outer circumferential surface of the transfer roller 33 on a downstream side of the elongated cleaning member 102 in the rotational direction RD of the transfer roller 33 and extending along the part of the length of the transfer roller 33 in the longitudinal direction LD. The elongated cleaning member 102 may include a second bar brush 102. The first bar brushes 101-1, 101-2 and 101-3 are spaced from each other and arranged in a row along the longitudinal direction LD of the transfer roller 33. The third bar brushes 103-1, 103-2 and 103-3 are spaced from each other and arranged in a row along the longitudinal direction LD of the transfer roller 33. The third bar brushes 103-1, 103-2 and 103-3 are disposed in positions and ranges corresponding to the first bar brushes 101-1, 101-2 and 101-3 in the longitudinal direction LD of the transfer roller 33. The elongated cleaning member 102 may include an elongated roller in some examples, or a flexible sheet in other examples.

FIG. 5 shows three first bar brushes 101-1, 101-2 and 101-3, but the device 100' may include one, two, four or five first bar brushes 101. Alternatively, the device 100' may include six or more first bar brushes 101. FIG. 5 shows three third bar brushes 103-1, 103-2 and 103-3. In some examples, the device 100' may include one, two, four or five third bar brushes 103. In other examples, the device 100' may include six or more third bar brushes 103. The length of the first bar brush 101 and the third bar brush 103 may be determined, for example, according to the length of a sensor for reading an image adjustment pattern on the intermediate transfer belt 31. However, the length of the first bar brush 101 and the third bar brush 103 may be changed variously, depending on the intended purpose of cleaning.

The width of the front end surface (or the contact end) of the first bar brush 101 in the rotational direction RD of the transfer roller 33 may be 5 mm or more, and in some examples, 10 mm or more, so as to impart the first bar brush 101 with effective cleaning capability. The width of the front end surface (or the contact end) of the first bar brush 101 in the rotational direction RD of the transfer roller 33 may be 50 mm or less, and in some examples, 30 mm or less, so that the first bar brush 101 is inhibited from hindering the rotation of the transfer roller 33.

The width of the front end surface (or the contact end) of the second bar brush 102 in the rotational direction RD of the transfer roller 33 may be 3 mm or more, and in some examples, 5 mm or more, so as to impart the second bar brush 102 with an effective capability to uniformize the electric resistance. The width of the front end surface (or contact end) of the second bar brush 102 in the rotational direction RD of the transfer roller 33 may be 30 mm or less, and in some examples, 20 mm or less, so that the second bar brush 102 is inhibited from hindering the rotation of the transfer roller 33.

The width of the front end surface (or the contact end) of the third bar brush 103 in the rotational direction RD of the transfer roller 33 may be 5 mm or more, and in some examples, 10 mm or more, so as to impart the third bar brush 103 with effective cleaning capability. The width of the front end surface (or the contact end) of the third bar brush 103 in the rotational direction RD of the transfer roller 33 may be 50 mm or less, and in some examples, 30 mm or less, so that the third bar brush 103 is inhibited from hindering the rotation of the transfer roller 33.

With the second bar brush 102, the device 100' can make uniform, or reduce variations in the surface electric resistance on the outer circumferential surface of the transfer roller 33 caused by the first and third bar brushes 101 and 103, and the second bar brush 102 can also scrape off the toner dispersed away by the first and third bar brushes 101 and 103 on the outer circumferential surface of the transfer roller 33.

The second bar brush 102 may be disposed a predetermined distance away from the first bar brush 101 on a downstream side of the first bar brush 101 in the rotational direction RD of the transfer roller 33. With the provision of the spacing on the upstream side of the second bar brush 102, the second bar brush 102 can be imparted with the capability to make uniform the surface electric resistance. The distance of separation between the first bar brush 101 and the second bar brush 102 in the rotational direction RD of the transfer roller 33 may be 3 mm or more, and in some examples, 5 mm or more, so as to impart the second bar brush 102 with the effective capability to make uniform the surface electric resistance.

The third bar brush 103 may be disposed adjacent to the second bar brush 102 on a downstream side of the second bar brush 102 in the rotational direction RD of the transfer roller 33. With the provision of the third bar brush 103 on the downstream side of the second bar brush 102 and adjacent to the second bar brush 102, the brush bristles of the second bar brush 102 can be prevented from falling during rotation of the transfer roller 33, and the cleaning capability of the second bar brush 102 can thereby be enhanced.

When the fiber density (number/cm2) of the second bar brush 102 is increased, the contact between the transfer roller 33 and the second bar brush 102 is improved, and the capability of the second bar brush 102 to make uniform the surface electric resistance is enhanced. However, if the fiber density of the second bar brush 102 is simply increased, the contact resistance (frictional resistance) between the second bar brush 102 and the transfer roller 33 is increased and may hinder the rotation of the transfer roller 33. As such, when the fiber density of the second bar brush 102 is made higher than the fiber density (number/$cm^2$) of the first bar brush 101, the fiber diameter (denier) of the second bar brush 102 may also be made smaller than the fiber diameter (denier) of the first bar brush 101, in order to inhibit hindering the rotation of the transfer roller 33. Accordingly, the second bar brush 102 may have a fiber diameter smaller than the fiber diameter of the first bar brush 101 and a fiber density higher than the fiber density of the first bar brush 101. Similarly, the second bar brush 102 may have a fiber diameter smaller than the fiber diameter (denier) of the third bar brush 103 and a fiber density higher than the fiber density (number/$cm^2$) of the third bar brush 103. The fiber density of the third bar brush 103 may be the same as or different from the fiber density of the first bar brush 101.

When the other conditions such as the fiber length and the fiber material are constant, the second bar brush 102 may have a fiber stress (N) smaller (e.g. lower) than the fiber stress (N) of the first bar brush 101 when the fiber diameter (denier) of the second bar brush 102 is smaller than the fiber diameter (denier) of the first bar brush 101, and may have a fiber stress (N) smaller (e.g. lower) than the fiber stress (N) of the third bar brush 103 when the fiber diameter of the second bar brush 102 is smaller than the fiber diameter (denier) of the third bar brush 103.

In an example, in each of the first, second and third bar brushes 101, 102 and 103, the product of the fiber diameter (denier) and the fiber density (number/$cm^2$) may be 200,000 or more, and in some examples 400,000 or more, so as to improve cleaning capability. Further, in each of the first, second and third bar brushes 101, 102 and 103, the product of the fiber diameter (denier) and the fiber density (number/$cm^2$) may be 1,000,000 or less, and in some examples, 600,000 or less, in order to inhibit hindering the rotation of the transfer roller 33.

The device 100' may further include a bias application unit 110 to apply to the transfer roller 33 a bias voltage ("removal bias") having the same polarity as a charge polarity of the toner attached to the transfer roller 33. For example, the bias application unit 110 of the device example 100' may be similar to the bias application unit 110 of the example device 100.

As shown in FIG. 4, in the example device 100' the front end surface (or the contact end) of each of the first, second and third bar brushes 101, 102 and 103 may have a profile curved along the outer circumferential surface of the transfer roller 33. The brush bristles of each bar brush may thus be made to contact with the outer circumferential surface of the transfer roller 33 at a substantially uniform pressure in the rotational direction RD of the transfer roller 33, and the cleaning capability of each of the first, second and third bar brushes 101, 102 and 103 may be increased as compared with cases where the front end surface (or the contact end) of each bar brush has a planar profile.

The example device 100' may further include a base member 105 having a curved surface 107 parallel to the outer circumferential surface of the transfer roller 33. In the device 100', each of the first, second and third bar brushes 101, 102 and 103 may include brush bristles extending substantially perpendicularly from the curved surface 107 of the base member 105 to the outer circumferential surface of the transfer roller 33. For example, the brush bristles may extend oriented substantially radially relative to the curved surface 107 of the base member 105 or relative to the outer circumferential surface of the transfer roller 33, or the brush bristles may be oriented substantially perpendicularly to tangents of the curved surface 107 of the base member 105 or to the outer circumferential surface of the transfer roller 33. With the first, second and third bar brushes 101, 102 and 103 each including brush bristles extending substantially perpendicularly to the outer circumferential surface of the transfer roller 33, a high cleaning capability can be obtained for each of the first, second and third bar brushes 101, 102 and 103.

Each of the first, second and third bar brushes 101, 102 and 103 includes a flexible sheet, such as a base fabric, and the brush bristles planted on the flexible sheet, and the flexible sheet is fixed onto the curved surface 107 of the base member 105 using a double-sided adhesive tape or an adhesive, such that the tip ends of the brush bristles make contact with the outer circumferential surface of the transfer roller 33. The brush bristles may be electrically insulating or conductive. If the brush bristles are electrically insulating, the brush bristles may be made of, for example, PET, nylon, acrylic, or a combination of these. If the brush bristles are electrically conductive, the bar brushes 101, 102 and 103 may be made to electrically float relative to the transfer roller 33. The length of the brush bristles of each of the first, second and third bar brushes 101, 102 and 103 may be substantially constant. As far as the difference between the maximum amount of engagement and the minimum amount of engagement of the brush bristles of each of the first, second and third bar brushes 101, 102 and 103 with the transfer roller 33 is within 1.0 mm, the bar brushes can be made to contact with the transfer roller 33 at a substantially uniform pressure, while tolerating manufacturing errors and assembly variations in each of the first, second and third bar brushes 101, 102 and 103.

Figure 6:
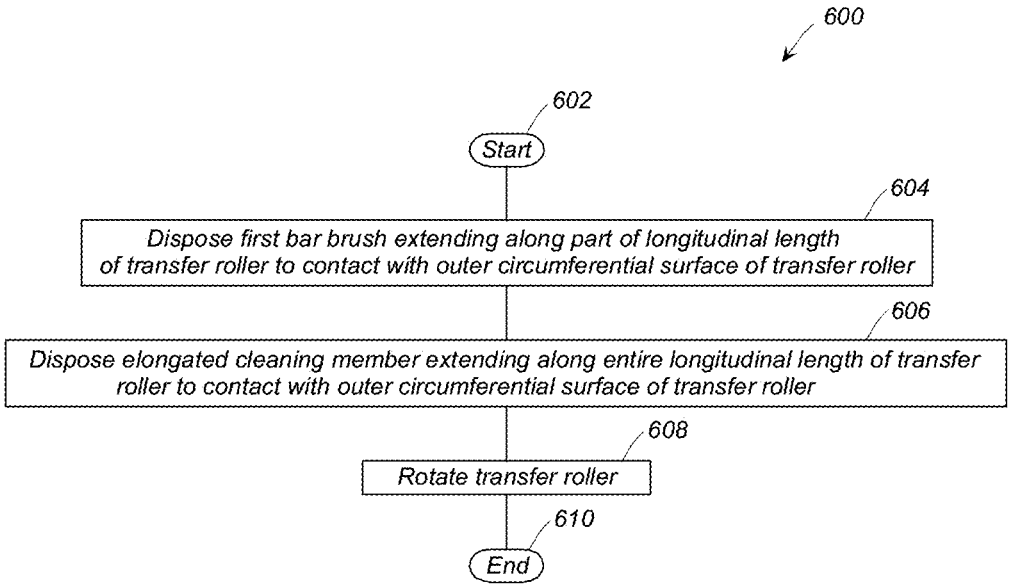
FIG. 6 is a flow diagram of an example method for removing toner attached to a transfer roller.

FIG. 6 is a flow diagram showing an example method 600 of removing toner attached to a transfer roller in an example image forming apparatus. The method 600 starts from a block 602 and proceeds to a block 604, where a first bar brush extending along part of a longitudinal length of the transfer roller is disposed to contact with an outer circumferential surface of the transfer roller. At block 606, an elongated cleaning member extending along the entire longitudinal length of the transfer roller is disposed to contact with the outer circumferential surface of the transfer roller. At block 608, the transfer roller is rotated. At block 610, the method 600 is completed. The method 600 may be performed using the device 100 shown in FIG. 2, for example.

At block 606, the disposing of the elongated cleaning member to contact with the outer circumferential surface of the transfer roller may include disposing the elongated cleaning member on a downstream side of the first bar brush in a rotational direction of the transfer roller, with spacing from the first bar brush. At block 608, the rotating of the transfer roller may include rotating the transfer roller while applying to the transfer roller a bias voltage ("removal bias") having the same polarity as a charge polarity of the toner attached to the transfer roller. The elongated cleaning member may include a second bar brush. The second bar brush may have a fiber stress smaller (e.g. lower) than the fiber stress of the first bar brush and a fiber density larger than the fiber density of the first bar brush. The second bar brush may have a fiber diameter smaller than the fiber diameter of the first bar brush and a fiber density larger than the fiber density of the first bar brush. The front end surface (or the contact end) of each of the first and second bar brushes may have a profile curved along the outer circumferential surface of the transfer roller.

Figure 7:
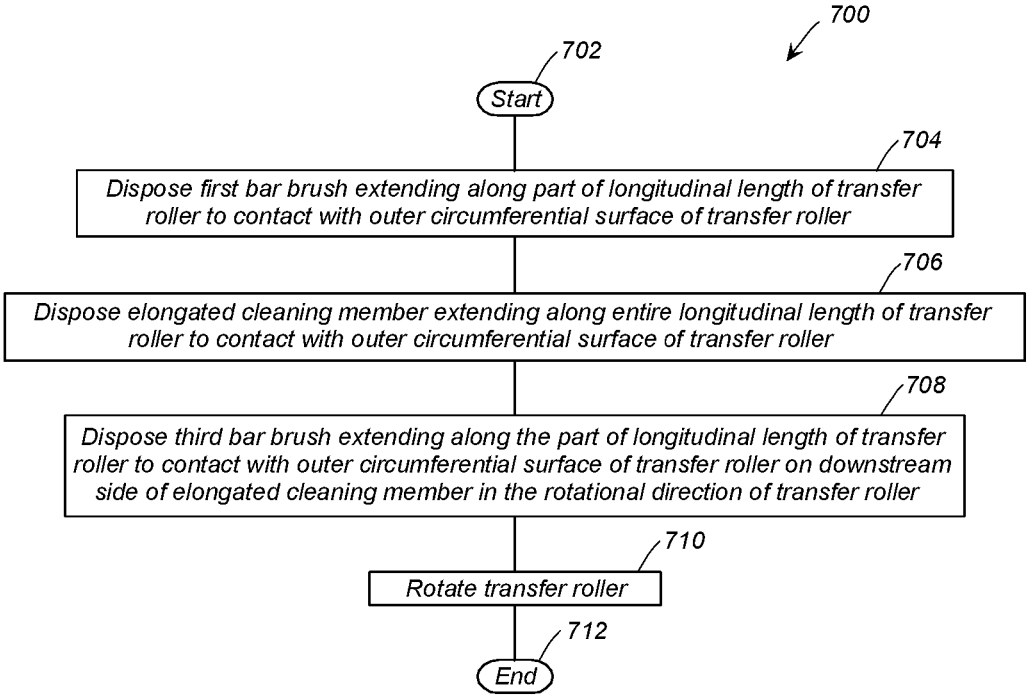
FIG. 7 is a flow diagram of an example method for removing toner attached to a transfer roller.

FIG. 7 is a flow diagram showing a method 700 of removing toner attached to a transfer roller in an example image forming apparatus. The method 700 starts from a block 702 and proceeds to a block 704, where a first bar brush extending along part of a longitudinal length of the transfer roller is disposed to contact with an outer circumferential surface of the transfer roller. At block 706, an elongated cleaning member extending along the entire longitudinal length of the transfer roller is disposed to contact with the outer circumferential surface of the transfer roller. At block 708, a third bar brush extending along the part of the longitudinal length of the transfer roller is disposed to contact with the outer circumferential surface of the transfer roller on a downstream side of the elongated cleaning member in the rotational direction of the transfer roller. At block 710, the transfer roller is rotated. At block 712, the method 700 is completed. The method 700 may be performed using the device 100' shown in FIG. 4.

At block 706, the disposing of the elongated cleaning member to contact with the outer circumferential surface of the transfer roller may include disposing the elongated cleaning member on a downstream side of the first bar brush in a rotational direction of the transfer roller, with spacing from the first bar brush. At block 708, the disposing of the third bar brush to contact with the outer circumferential surface of the transfer roller on the downstream side of the elongated cleaning member in the rotational direction of the transfer roller may include disposing the third bar brush adjacent to the elongated cleaning member on the downstream side of the elongated cleaning member in the rotational direction of the transfer roller. At block 710, the rotating of the transfer roller may include rotating the transfer roller while applying to the transfer roller a bias voltage ("removal bias") having the same polarity as a charge polarity of the toner attached to the transfer roller. The elongated cleaning member may include a second bar brush. The second bar brush may have a fiber stress smaller (e.g. lower) than the fiber stress of the first bar brush and a fiber density larger than the fiber density of the first bar brush. The second bar brush may have a fiber diameter smaller than the fiber diameter of the first bar brush and a fiber density larger than the fiber density of the first bar brush. The second bar brush may have a fiber stress smaller (e.g. lower) than the fiber stress of the third bar brush and a fiber density larger than the fiber density of the third bar brush. The second bar brush may have a fiber diameter smaller than the fiber diameter of the third bar brush and a fiber density larger than the fiber density of the third bar brush. The front end surface (or the contact end) of each of the first, second and third bar brushes may have a profile curved along the outer circumferential surface of the transfer roller.

It is to be understood that not all aspects, advantages and features described herein may necessarily be achieved by, or included in, any one particular example. Indeed, having described and illustrated various examples herein, it should be apparent that other examples may be modified in arrangement and detail.

The invention claimed is:

1. A toner removal device for removing toner attached to a transfer roller in an image forming apparatus, the toner removal device comprising:

a bar brush to contact an outer circumferential surface of the transfer roller, wherein the bar brush extends along a part of a longitudinal length of the transfer roller; and an elongated cleaning member to contact the outer circumferential surface of the transfer roller, wherein the elongated cleaning member extends along the longitudinal length, entirely, of the transfer roller.

2. The toner removal device according to claim 1, comprising:

a bias application unit to apply a bias voltage to the transfer roller, the bias voltage having a same polarity as a charge polarity of the toner attached to the transfer roller.

3. The toner removal device according to claim 1, wherein the elongated cleaning member is spaced apart from the bar brush, and located downstream of the bar brush relative to a rotational direction of the transfer roller.

4. The toner removal device according to claim 1, wherein the bar brush comprises a first bar brush and the elongated cleaning member comprises a second bar brush, and wherein the second bar brush has a fiber stress lower than a fiber stress of the first bar brush and a fiber density higher than a fiber density of the first bar brush.

5. The toner removal device according to claim 4, comprising:

a third bar brush to contact with the outer circumferential surface of the transfer roller, wherein the third bar brush is located downstream of the second bar brush relative to the rotational direction of the transfer roller, and extends along the part of the longitudinal length of the transfer roller which the first bar brush extends along, wherein the fiber stress of the second bar brush is lower than a fiber stress of the third bar brush and the fiber density of the second bar brush is higher than a fiber density of the third bar brush.

6. The toner removal device according to claim 5, wherein the second bar brush is spaced apart from the first bar brush, and located downstream of the first bar brush relative to the rotational direction of the transfer roller, and the third bar brush is in abutment with the second bar brush downstream the second bar brush relative to the rotational direction of the transfer roller.

7. The toner removal device according to claim 5, wherein the first bar brush, the second bar brush and the third bar brush have contact ends, respectively, to contact the transfer roller, wherein the contact ends form a profile that is curved along the outer circumferential surface of the transfer roller.

8. The toner removal device according to claim 5, comprising:

a base member having a curved surface parallel to the outer circumferential surface of the transfer roller, wherein the first bar brush, the second bar brush and the third bar brush include brush bristles extending from the curved surface of the base member toward the outer circumferential surface of the transfer roller, and wherein the brush bristles are oriented substantially along respective normals of the curved surface of the base member.

9. A method of removing toner attached to a transfer roller in an image forming apparatus, comprising:

rotating the transfer roller;

contacting an outer circumferential surface of the transfer roller along a part of a longitudinal length of the transfer roller, with a bar brush; and contacting the outer circumferential surface of the transfer roller along the entire longitudinal length of the transfer roller, with an elongated cleaning member.

10. The method of claim 9, comprising:

while rotating the transfer roller, applying to the transfer roller a bias voltage having a same polarity as a charge polarity of the toner attached to the transfer roller.

11. The method according to claim 9, wherein the elongated cleaning member contacts the outer circumferential surface of the transfer roller downstream of the bar brush contacting the outer circumferential surface of the transfer roller, relative to a rotational direction of the transfer roller, with spacing from the bar brush.

12. The method according to claim 11, wherein the bar brush comprises a first bar brush and the elongated cleaning member comprises a second bar brush, and wherein the first bar brush and the second bar brush contact the outer circumferential surface of the transfer roller with respective frictional resistances which are substantially equivalent.

13. The method according to claim 12, comprising contacting the outer circumferential surface of the transfer roller along the part of the longitudinal length of the transfer roller that is contacted by the first bar brush, with a third bar brush, downstream of the second bar brush in the rotational direction of the transfer roller.

14. The method according to claim 13, wherein the second bar brush and the third bar brush contact the outer circumferential surface of the transfer roller with respective frictional resistances which are substantially equivalent.

15. An image forming apparatus comprising:

a transfer roller extending along a longitudinal orientation, the transfer roller having a surface to receive toner, the surface having a longitudinal length in the longitudinal orientation; and a toner removal device adjacent the transfer roller, the toner removal device comprising;

a first brush to contact the surface of the transfer roller, wherein the first brush is aligned with a portion of the longitudinal length of the surface of the transfer roller; and a second brush to contact the surface of the transfer roller, wherein the second brush extends along the longitudinal length, entirely, of the surface of the transfer roller.

* * * * *